US007677291B2

(12) United States Patent
Matsushita

(10) Patent No.: US 7,677,291 B2
(45) Date of Patent: Mar. 16, 2010

(54) ENGAGING DEVICE AND TRANSFER INSTRUMENT

(75) Inventor: Kinya Matsushita, Osaka (JP)

(73) Assignee: Kokuyo S&T Co., Ltd. (JP)

( * ) Notice: Subject to any disclaimer, the term of this patent is extended or adjusted under 35 U.S.C. 154(b) by 1097 days.

(21) Appl. No.: 11/298,688

(22) Filed: Dec. 12, 2005

(65) Prior Publication Data

US 2006/0151657 A1 Jul. 13, 2006

(30) Foreign Application Priority Data

Dec. 28, 2004 (JP) ..... P2004-381058

(51) Int. Cl.
*B65C 9/18* (2006.01)
*B44C 7/02* (2006.01)
*A44B 11/25* (2006.01)

(52) U.S. Cl. ..... 156/577; 156/230; 156/238; 156/523; 156/527; 156/574; 24/489; 24/518; 24/543

(58) Field of Classification Search ..... 24/518, 24/543; 156/577, 523, 230, 238, 527, 574
See application file for complete search history.

(56) References Cited

U.S. PATENT DOCUMENTS 3,698,681 A * 10/1972 Lacey ..... 251/10
3,854,482 A * 12/1974 Laugherty et al. ..... 606/120
4,588,469 A * 5/1986 Hunter ..... 156/527
4,591,407 A * 5/1986 Samuelson ..... 156/527
4,897,900 A * 2/1990 Baggett ..... 24/543
5,163,941 A * 11/1992 Garth et al. ..... 606/108
5,312,501 A * 5/1994 Gruber et al. ..... 156/238
5,360,352 A * 11/1994 Rudy et al. ..... 439/469
5,423,103 A * 6/1995 Born ..... 15/97.1
5,445,703 A * 8/1995 Steeves et al. ..... 156/544
5,456,792 A * 10/1995 Rodriguez et al. ..... 156/577
5,597,000 A * 1/1997 Gerber ..... 132/279
5,598,608 A * 2/1997 Naslund ..... 24/30.5 R
5,942,036 A 8/1999 You
5,964,650 A * 10/1999 Born et al. ..... 451/63

(Continued)

FOREIGN PATENT DOCUMENTS

DE 2806756 7/1979

(Continued)

OTHER PUBLICATIONS

EP 05 02 7891, European Search Report, dated Apr. 12, 2006.

*Primary Examiner*—Khanh Nguyen
*Assistant Examiner*—Carson Gross
(74) *Attorney, Agent, or Firm*—Banner & Witcoff, Ltd.

(57) ABSTRACT

An engaging device is provided which is capable of advantageous switchover from an engaging position to an open position. Also provided is a transfer instrument employing the structure of such an engaging device. The transfer instrument (A) includes the engaging device (X) which is capable of gradually moving an engaging surface (23) widthwise of an engaging surface (13) to retract two engaging components relative to each other by pivotally moving a dangling wall (11) of a transfer instrument body (1) and a sidewall (21) of an arm (2) relative to each other to press a sliding contact edge (24) against a guide edge (14) gradually from a first end portion (14*a*) toward an opposite second end portion (14*b*) of the guide edge (14).

14 Claims, 9 Drawing Sheets

U.S. PATENT DOCUMENTS

| | | | | |
|---|---|---|---|---|
| 6,016,588 | A | 1/2000 | Kamerschen | |
| 6,125,903 | A * | 10/2000 | Uchida | 156/540 |
| 6,145,169 | A * | 11/2000 | Terzuola et al. | 24/170 |
| 6,460,231 | B2 * | 10/2002 | Bourgerie | 24/487 |
| 6,699,110 | B2 * | 3/2004 | Lee | 451/242 |
| 6,960,122 | B2 * | 11/2005 | Lin | 451/285 |
| 7,036,545 | B2 * | 5/2006 | Velasquez et al. | 156/527 |
| 7,131,169 | B2 * | 11/2006 | Folkmar | 24/30.5 R |
| 7,181,806 | B2 * | 2/2007 | Folkmar | 24/30.5 R |
| 7,201,352 | B2 * | 4/2007 | Kawai | 248/74.1 |
| 7,207,877 | B1 * | 4/2007 | Lin et al. | 451/523 |
| 2003/0124962 | A1 * | 7/2003 | Lee | 451/242 |
| 2004/0033353 | A1 | 2/2004 | You | |
| 2004/0250385 | A1 * | 12/2004 | Folkmar | 24/543 |
| 2005/0056377 | A1 * | 3/2005 | Tominaga | 156/540 |
| 2005/0072529 | A1 * | 4/2005 | Yonezawa et al. | 156/540 |
| 2005/0139326 | A1 * | 6/2005 | Mitsui et al. | 156/540 |
| 2005/0139327 | A1 * | 6/2005 | Mitsui et al. | 156/577 |
| 2005/0150605 | A1 * | 7/2005 | Mitsui et al. | 156/540 |
| 2005/0155717 | A1 * | 7/2005 | Mitsui et al. | 156/577 |
| 2006/0086464 | A1 * | 4/2006 | Yanagida et al. | 156/542 |
| 2007/0051474 | A1 * | 3/2007 | Grenier | 156/577 |

FOREIGN PATENT DOCUMENTS

| | | |
|---|---|---|
| GB | 2216175 | 10/1989 |
| JP | 7-18676 | 5/1995 |
| JP | 08040630 | 2/1996 |
| JP | 3459686 | 8/2003 |

* cited by examiner (a)

(b)

(a)

(b)

(a)

(b)

ENGAGING DEVICE AND TRANSFER INSTRUMENT

BACKGROUND OF THE INVENTION

1. Field of the Invention

The present invention relates to an engaging device capable of engaging/disengaging two members as well as a transfer instrument employing the engaging device.

2. Description of the Related Art

Hitherto, wide use has been made of an engaging device structured to engage one member with another by means of a claw capable of engaging such members. Specifically, such an engaging device includes engaging components provided on respective of the two members, the engaging components having respective engaging surfaces. The engaging device is configured such that the two engaging components can take an engaging position in which the two engaging surfaces face each other and an open position in which the two engaging surfaces are spaced apart from each other switchably. Particularly, the engaging device is configured such that the two engaging components take relatively retracted positions temporarily in the course of moving from the engaging position to the open position or vice versa (see the following patent documents 1 and 2 for example).

Patent document 1: Japanese Utility Model Publication No. HEI 7-18676 (FIG. 1 and the like)

Patent document 2: Japanese Patent No. 3459686 (FIG. 1 and the like)

However, in cases where the aforementioned engaging device is used in such a manner that the engaging position and the open position are frequently switched to each other repeatedly, the user may feel tired of performing an operation for releasing the engaging components from the engaging position. Further, it is possible that the claw is damaged by the user trying to release the engaging components kept engaged from the engaging position forcibly due to being oblivious of conducting the operation of releasing the engagement.

In view of such an inconvenience the present invention intends to provide an engaging device capable of advantageously releasing the engaging components from the engaging position as well as a transfer instrument employing the structure of such an engaging device to allow the user to use the transfer instrument conveniently.

SUMMARY OF THE INVENTION

In order to attain the foregoing object, the present invention provides the following means.

That is, the present invention provides an engaging device comprising: a first member having a first engaging component with a first engaging surface, and a second member having a second engaging component with a second engaging surface capable of facing the first engaging surface, the first and second engaging components being capable of taking an engaging position in which the first and second engaging surfaces face each other and an open position in which the first and second engaging surfaces are spaced apart from each other, switchably through a relatively retracting action to retract the first and second engaging components relative to each other temporarily; a guide edge formed on the first engaging component in such a manner as to increase a width of the first engaging surface gradually as the guide edge extends from a first end side thereof to an opposite second end side thereof; a sliding contact edge formed on the second engaging component to extend obliquely relative to the guide edge and capable of abutting against the guide edge; and position control means configured to press the sliding contact edge against the guide edge gradually from the first end side of the guide edge toward the opposite second end side of the guide edge when an external force is exerted to move the engaging components from the engaging position toward the open position.

Such an engaging device is capable of gradually moving the second engaging surface widthwise of the first engaging surface to retract the two engaging components relative to each other by moving the first and second members relative to each other to press the sliding contact edge against the guide edge gradually from the first end side of the guide edge toward the opposite second end side of the guide edge. Thus, gradual switchover from the engaging position to the open position makes it possible to reduce the load to be imposed on the two engaging components and lessen the force to be exerted to release the engagement. Further, in releasing the engagement the engaging device can impart the user with a sense of being resisted for a certain period of time and hence allows the user to notice the switchover from the engaging position to the open position clearly. Moreover, even though the engaging device is capable of releasing the engagement by a lessened external force, the engagement cannot be released unless such an external force is exerted for a certain period of time. For this reason, it is not likely that the engagement is released accidentally.

The present invention also provides a transfer instrument comprising: a transfer instrument body having a transfer head capable of transferring a transferee to such a transfer object as paper; an arm accompanying the transfer instrument body for backing up the transfer object; and an engaging device capable of engaging the transfer instrument body with the arm, the engaging device including first and second members each provided on a respective one of the transfer instrument body and the arm, the first member having a first engaging component with a first engaging surface, the second member having a second engaging component with a second engaging surface capable of facing the first engaging surface, the first and second engaging components being capable of taking an engaging position in which the first and second engaging surfaces face each other while the arm and a tip portion of the transfer head are positioned to be capable of holding the transfer object therebetween and an open position in which the first and second engaging surfaces are spaced apart from each other while the tip portion of the transfer instrument body exposed, switchably through a relatively retracting action to retract the first and second engaging components relative to each other temporarily.

Such a transfer instrument is capable of advantageous switchover from a state allowing the transfer instrument body and the arm to hold the transfer object therebetween for the transferee to be suitably transferred to the transfer object to a state taking the open position which is assumed by releasing the engaging position and which allows the transferee to be suitably transferred to the transfer object placed on a desk like a conventional transfer instrument.

In order for the sliding contact edge to press against the guide edge gradually from the first end side toward the opposite second end side suitably in switchover from the engaging position to the open position, the first and second engaging surfaces are desirably slanted relative to each other to become close to each other on the first end side.

In order for the position control means to have a simplified structure and a high operational precision, the position control means desirably comprises a pivoting mechanism connecting the first and second members for pivotal movement. In the case where the pivoting mechanism is adopted, the first end side of the guide edge is preferably positioned on a distal pivoting end side in order to reduce the load to be imposed on a pivot shaft. By so doing, the position control means is configured to press the sliding contact edge against the guide edge gradually from the distal pivoting end side on which the amount of move is relatively large, whereby a reduced pivoting range is necessary for the open position to be reached.

For the relatively retracting action to be performed without the need for separate provision of any special structure, it is desirable that the pivoting mechanism have a pivoting shaft configured to move the first and second members widthwise of the first engaging surface to allow the relatively retracting action to be performed.

Alternative means for causing the relatively retracting action to be performed advantageously may be configured such that at least one of the first and second members is capable of becoming deflected widthwise of the first engaging surface to allow the relatively retracting action to be performed.

Particularly, the transfer instrument may have a configuration wherein: the first member forms a sidewall provided on the transfer instrument body and the sidewall is formed with a ridge serving as the first engaging component, the ridge having one surface serving as the first engaging surface and a protruding edge formed with the guide edge; the second member forms a sidewall provided on the arm and the sidewall is formed with a ridge serving as the second engaging component, the ridge having one surface serving as the second engaging surface and a protruding edge formed with the sliding contact edge; and the two ridges are positioned to face each other at a location adjacent proximal pivoting ends of the sidewalls. This configuration makes it possible to dispose principle parts of the transfer instrument including the transfer head around the distal pivoting end.

A preferable specific structure configured to allow the relatively retracting action to be advantageously performed comprises, in addition to the aforementioned configuration, a feature that at least one of the sidewalls is formed of resin and thicknesswise elastic deformation of the sidewall is utilized to allow the relatively retracting action to be performed.

Preferably, the structure configured to allow the relatively retracting action to be advantageously performed in switchover from the open position to the engaging position is such that at least one of the two ridges is formed with a retraction guide surface for allowing the relatively retracting action to be performed when an external force is exerted to move the first and second engaging components from the engaging position toward the open position.

In order to allow the second engaging surface to move widthwise advantageously by reducing the load to be imposed on the guide edge and sliding contact edge, the guide edge is desirably chamfered. Examples of specific chamfering include C-surface chamfering and R-surface chamfering.

The engaging device according to the present invention is capable of gradually moving the second engaging surface widthwise of the first engaging surface to retract the two engaging components relative to each other by moving the first and second members relative to each other to press the sliding contact edge against the guide edge gradually from the first end side toward the opposite second end side of the guide edge. Thus, such gradual switchover from the engaging position to the open position makes it possible to reduce the load to be imposed on the two engaging components, hence, improve the durability thereof effectively. Also, the engaging device is capable of reliably maintaining the engaging state at the engaging position while enabling the engagement to be released by a lessened working force. Further, in releasing the engagement the engaging device can impart the user with a sense of being resisted for a certain period of time and hence allows the user to notice the switchover from the engaging position to the open position clearly.

The transfer instrument including the above-described engaging device according to the present invention is capable of advantageous switchover from a state taking the engaging position which allows the transfer instrument body and the arm to hold the transfer object therebetween for the transferee to be suitably transferred to the transfer object to a state taking the open position which is assumed by releasing the engaging position and which allows the transferee to be suitably transferred to the transfer object placed on a desk like a conventional transfer instrument. Particularly, by effectively reducing the load to be imposed on the engaging components, the transfer instrument can be effectively improved in its own durability.

The foregoing and other object, features and attendant advantages of the present invention will become more apparent from the reading of the following detailed description of the invention in conjunction with the accompanying drawings.

DETAILED DESCRIPTION OF THE PREFERRED EMBODIMENTS

Hereinafter, a transfer instrument A including an engaging device X according to one embodiment of the present invention will be described in detail with reference to the accompanying drawings.

Figure 1:
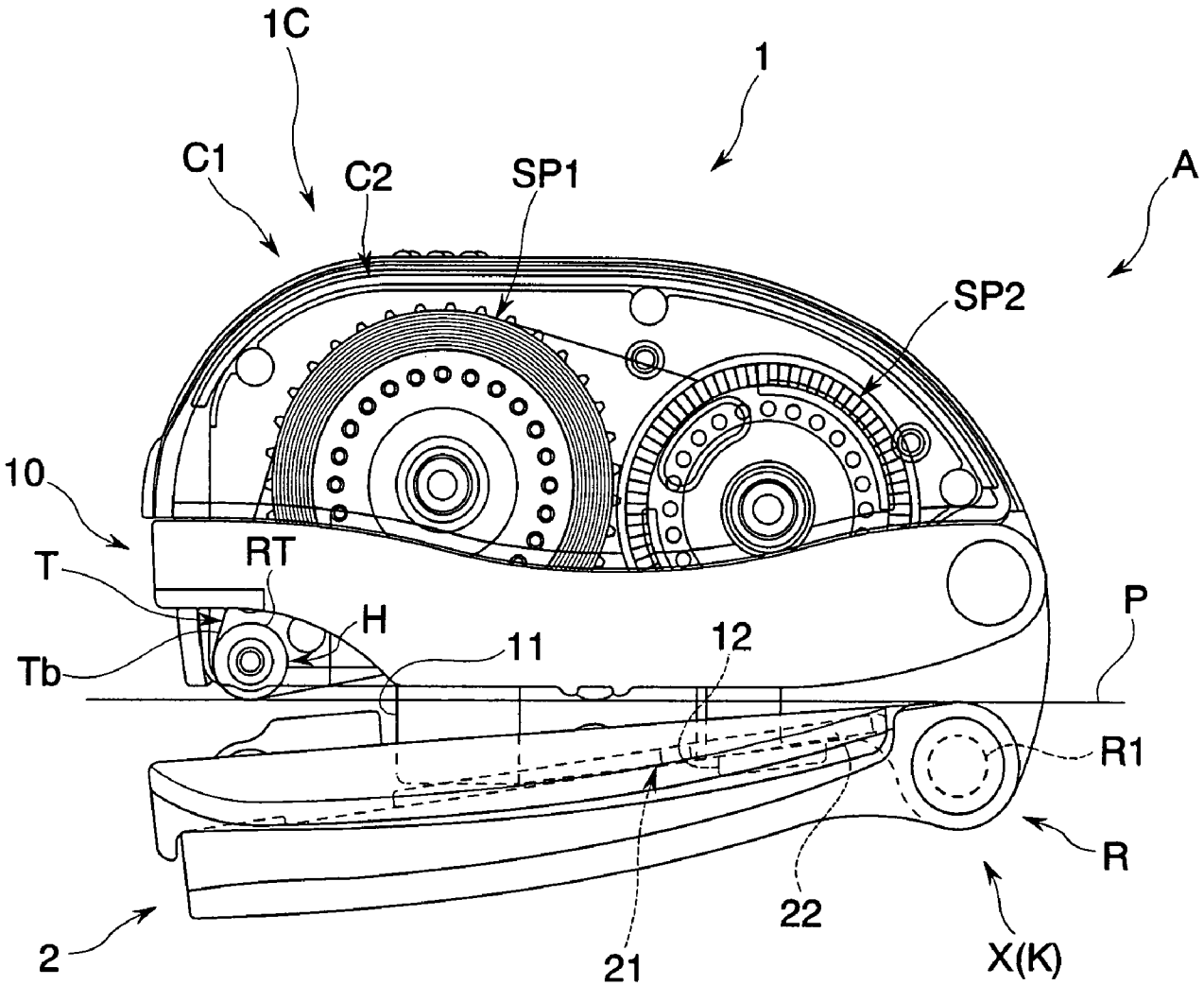
FIG. 1 is an overview showing a transfer instrument according to one embodiment of the present invention.
Figure 2:
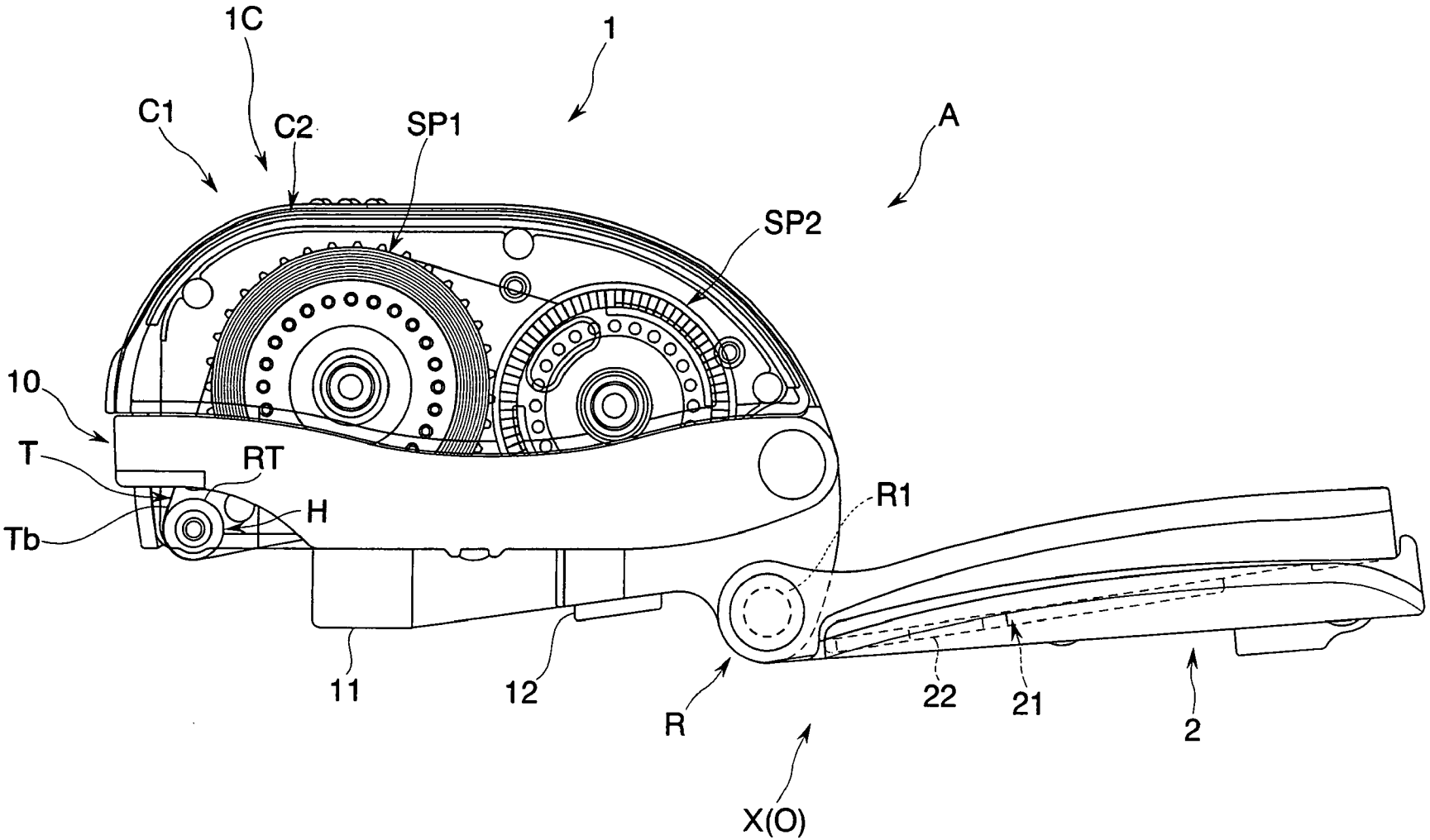
FIG. 2 is also an overview showing the transfer instrument.

As shown in FIGS. 1 and 2, the transfer instrument A includes a transfer instrument body 1 accommodating therein tape paste T and parts of a feeder mechanism for feeding the tape paste T, an arm 2 for holding a piece of paper P between the arm 2 and the transfer instrument body 1 and backing up the piece of paper P in transferring paste Tb, and a pivoting mechanism R connecting the transfer instrument body 1 and the arm 2 for pivotal movement to serve as position control means. The transfer instrument A is capable of taking an engaging position K shown in FIG. 1 in which the transfer instrument body 1 and the arm 2 hold the piece of paper P therebetween to allow the paste Tb to be transferred to the piece of paper P and an open position 0 shown in FIG. 2 in which the arm 2 is downwardly turned to expose a transfer head H to be described later so that the paste Tb is allowed to transfer to the piece of paper P placed on a desk or the like.

The transfer instrument A according to this embodiment includes the engaging device X comprising: a guide edge 14 formed on a projection 12 projecting from a dangling wall 11 which forms a first member of the transfer instrument body 1 to be described later; a sliding contact edge 24 formed on a ridge 22 protruding from a sidewall 21 to be described later of the arm 2; and the pivoting mechanism R as the position control means configured to cause the projection 12 and the ridge 22 to retract relative to each other temporarily, which is called a relatively retracting action S, by pressing the sliding contact edge 24 against the guide edge 14 gradually from a first end portion 14*a* toward an opposite second end portion 14*b* of the guide edge 14 when an external force is exerted to move first and second engaging surfaces 13 and 23 formed on respective of the projection 12 and the ridge 22 from the engaging position K in which the engaging surfaces 12 and 23 face each other toward the open position O in which the engaging surfaces 13 and 23 are spaced apart from each other.

Specific description will be made of the structure of the transfer instrument A with reference to FIGS. 1 to 5.

The transfer instrument body 1 includes a case 1C and a frame 10 as major components.

The case 1C comprises a case body Cl having a substantially mating-halves structure and a replaceable cartridge C2. The replaceable cartridge C2 has a front end portion fitted with the transfer head H. The replaceable cartridge C2 contains replaceable parts including the tape paste T as a consumable part, a pay-out spool SP1 as one of the parts of the feeder mechanism for feeding the tape paste T to the piece of paper P, a take-up spool SP2, and transfer head H for replacement with fresh ones together with the cartridge C2. The case body C1 is configured to enable the replacement of only the cartridge C2 without separating the frame 10 and arm 2 from the case body C1 in usual cases and hold irreplaceable ones of the parts of the feeder mechanism for feeding the tape paste T to the piece of paper P.

The frame 10 has both of the function of holding the case 1C to allow the transfer instrument A to be used and the function of making the case 1C assume a state allowing the case 1*c* to be separated into the case body C1 and the cartridge C2. Specifically, the frame 10 is a frame defining a vertically continuous opening and is integrally molded of synthetic resin. The frame 10 supports the case body C1 for pivotal movement. A transfer roller RT of the transfer head H is exposed from a lower portion of the frame 10.

The frame 10 is formed integrally with the dangling wall 11 serving as the first member at a Lower portion thereof for accurately positioning the piece of paper P in order to apply the paste Tb onto the piece of paper P along an edge thereof accurately and for engagement with the arm 2 in the engaging position K. Here, FIG. 3 is a plan view showing an outer portion of the engaging device X on the side opposite away from the side on which the dangling wall 11 contacts the piece of paper P; and FIG. 4 is an enlarged view showing a portion of concern of the engaging device X around the proximal pivoting end of the dangling wall 11.

Figure 3:
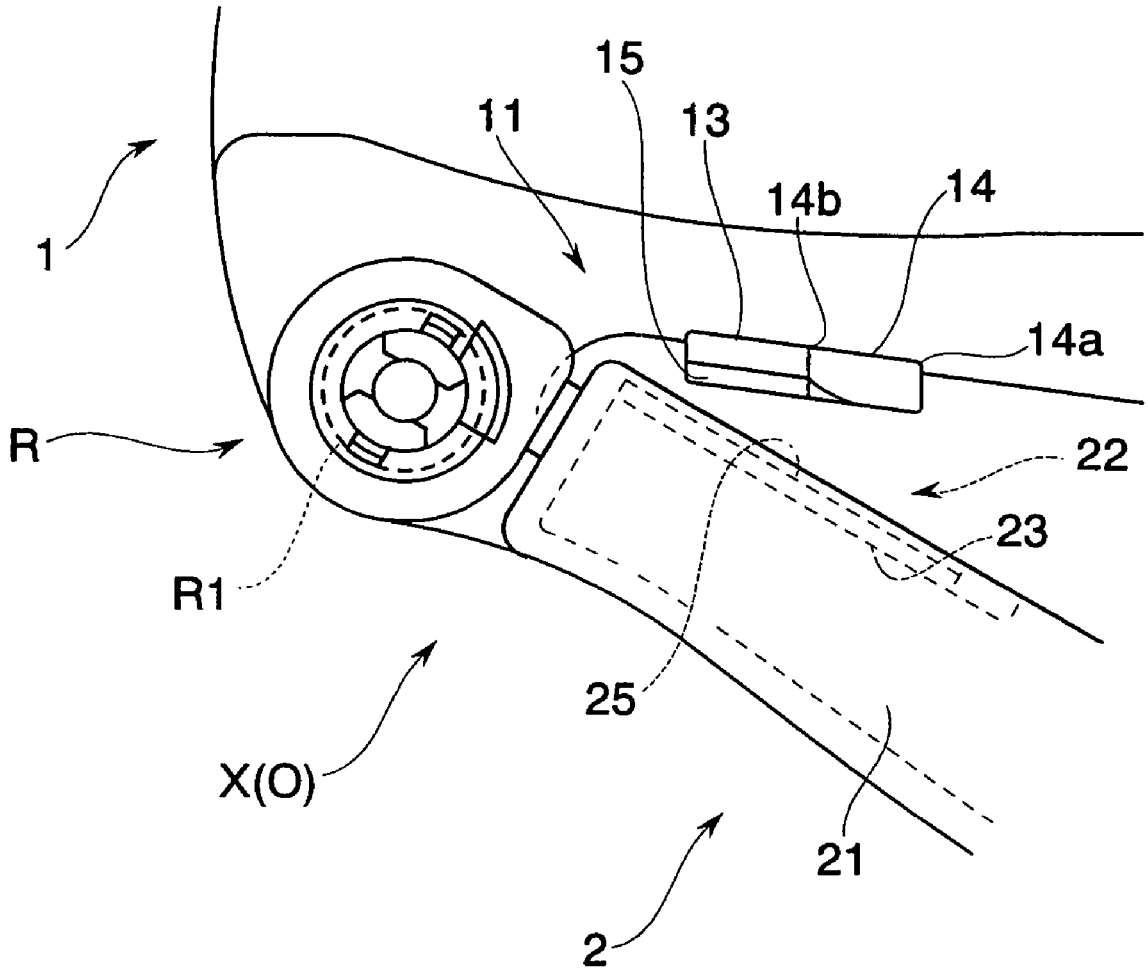
FIG. 3 is an enlarged view showing a portion of concern of an engaging device according to the same embodiment.
Figure 4:
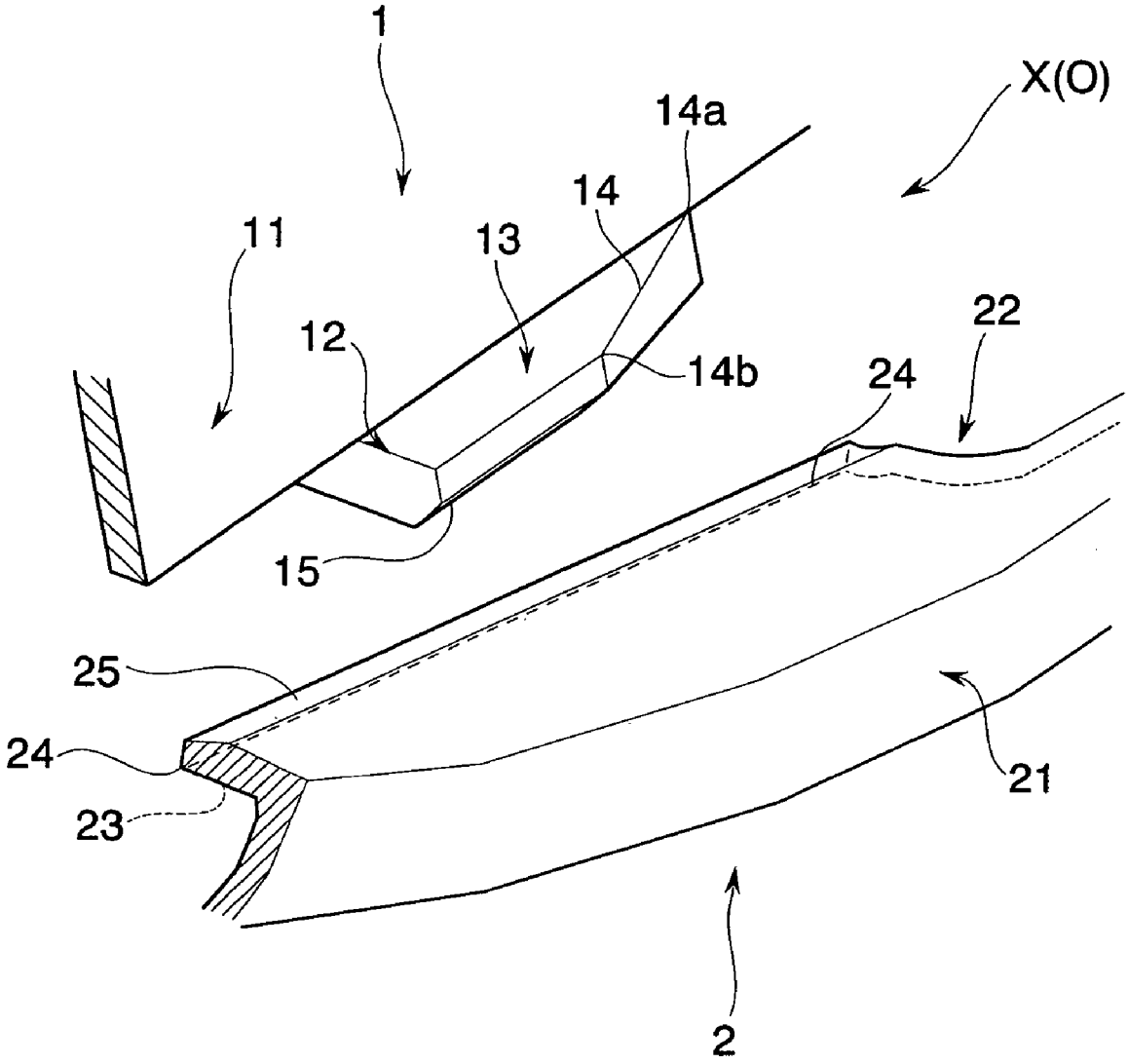
FIG. 4 is a partially enlarged view of the engaging device.

As shown in FIGS. 3 and 4, the dangling wall 11 has the ridge-shaped projection 12 in a lowermost portion thereof close to the proximal pivoting end, the projection 12 projecting toward the sidewall 21 to be described later of the arm 2. An upper surface of the projection 12 forms the first engaging surface 13. Further, the guide edge 14 is formed on a projecting edge of the projection 12 in such a manner as to gradually increase the projecting width, or the width of the first engaging surface 13 as the guide edge 14 extends from its first end portion 14*a* lying on the distal pivoting end side as the first end side to its second end portion 14*b* lying on the proximal pivoting end side as the second end side. Stated otherwise, the guide edge 14 extends toward the sidewall 21 serving as the second member in such a manner as to gradually increase the projecting width as the projection 12 extends from the first end portion 14*a* to the second end portion 14*b*. The reverse side of the projection 12 opposite away from the engaging surface 13 is chamfered to form a retraction guide surface 15.

Figure 5:
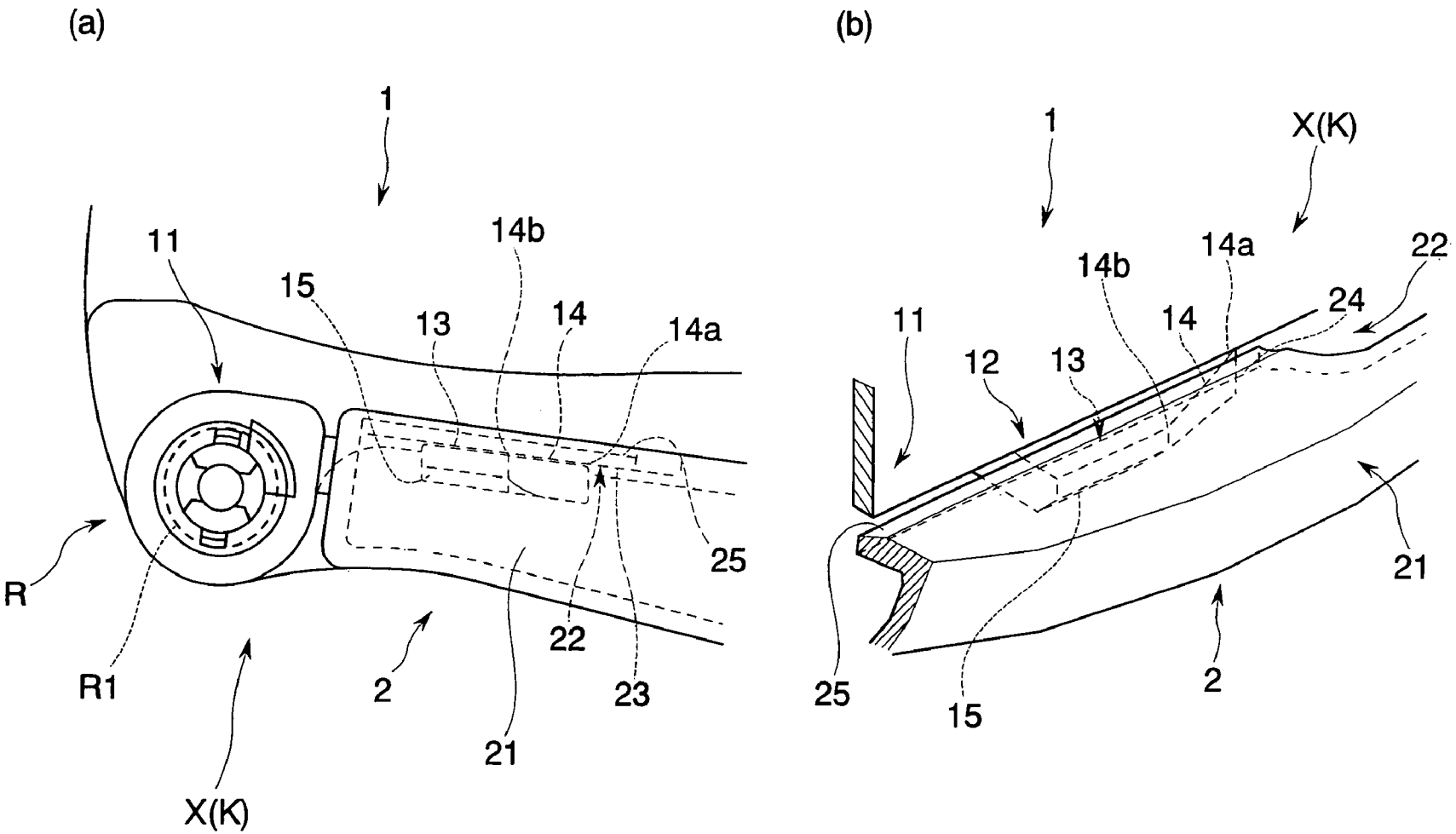
FIG. 5 is an illustration of a feature according to the same embodiment.

As shown in FIG. 1, the arm 2 cooperates with the frame 10 to define a space for insertion of the piece of paper P, the space having a predetermined height and extending in the fore-and-aft direction. The arm 2 is positioned to enable the sidewall 21 to face the dangling wall 11 in the engaging position K as shown in FIG. 5.

The upper edge of the sidewall 21 is partially protruded widthwise toward the dangling wall 11 to form the ridge 22 serving as the second engaging component. The ridge 22 has a lower surface forming the second engaging surface 23 capable of facing the engaging surface 13 of the projection 12 while being formed with the sliding contact edge 24 on the lower side of the projecting edge of the ridge 22, the sliding contact edge 24 being capable of pressing against the aforementioned guide edge 14 in an oblique direction. By chamfering the upper side of the projecting edge of the ridge 12 which is the reverse side opposite away from the sliding contact edge 24, a retraction guide surface 25 is formed which is capable of abutting against the aforementioned retraction guide surface 15 when an external force is exerted to move the arm 2 from the open position 0 toward the engaging position K.

The pivoting mechanism R connects the transfer instrument body 1 and the arm 2 for pivotal movement and employs a structure incorporating therein an elastic member R1 depicted by dotted line for allowing the transfer instrument body 1 and the arm 2 to move relative to each other temporarily in directions orthogonal to the longitudinal direction, that is, in directions thicknesswise of the dangling wall 11 and the sidewall 21. Stated otherwise, the pivoting mechanism R is configured to allow the transfer instrument body 1 and the arm 2 to return to their respective original positions by utilizing the elastic restoring force of the elastic member R1 even though the transfer instrument body 1 and the arm 2 have temporarily moved relative to each other in the widthwise direction. While the present embodiment employs a coil spring as the elastic member R1, it is possible to employ another well-known structure using a plate spring or the like instead of such a coil spring as used in the present embodiment.

Thus, by the provision of the engaging device X, the transfer instrument A is configured to support the transfer instrument body 1 and the arm 2 for pivotal movement and allow the arm 2 to take the engaging position K shown in FIG. 1 in which the piece of paper P can be held between the arm 2 and the front end portion of the transfer head H and the open position O shown in FIG. 2 in which the front end portion of the transfer head H is exposed, switchably through the relatively retracting action S.

The engaging device X comprises, as major components thereof, the guide edge 14 of the projection 12 formed on the dangling wall 11, the sliding contact edge 24 of the ridge 24 formed on the sidewall 21, and the pivoting mechanism R as the position control means configured to press the sliding contact edge 24 against the guide edge 14 gradually from the first end portion 14*a* toward the opposite second end portion 14*b* of the guide edge 14 when an external force is exerted to move the arm 2 from the engaging position K toward the open position O. Note that FIGS. 5(*a*), 6(*a*) and 7(*a*) schematically illustrate the front side of the engaging device X in operation and FIGS. 5(*b*), 6(*b*) and 7(*b*) schematically illustrate the upper side of the engaging device X in operation.

Figure 6:
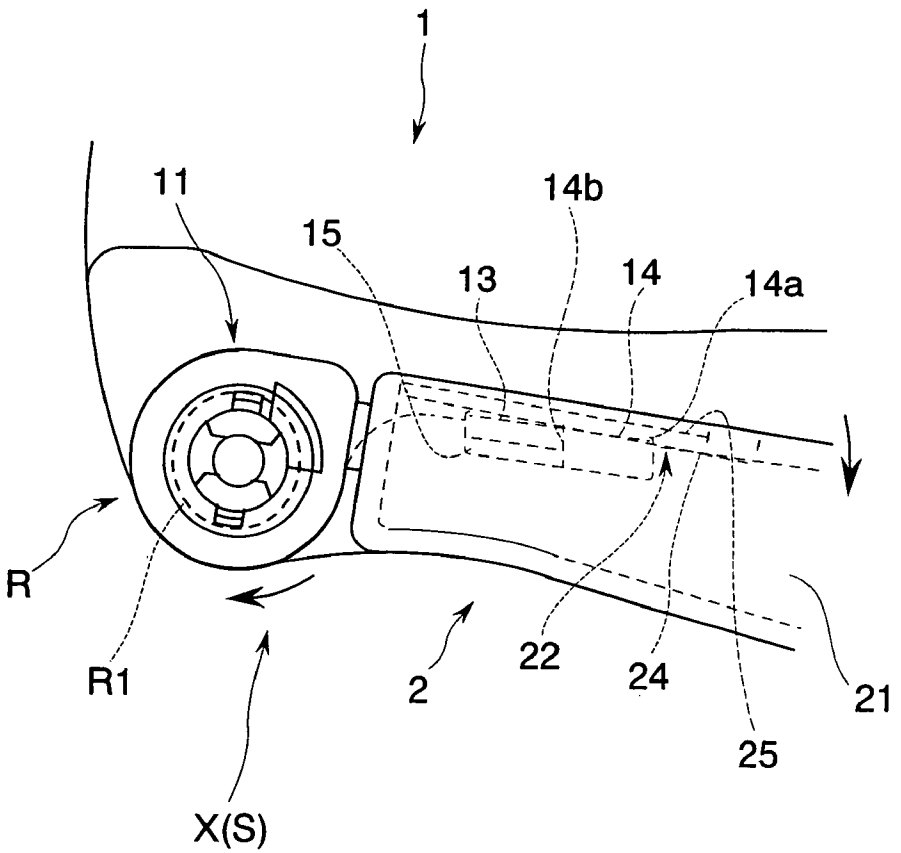
FIG. 6 is an illustration of a feature according to the same embodiment.
Figure 6:
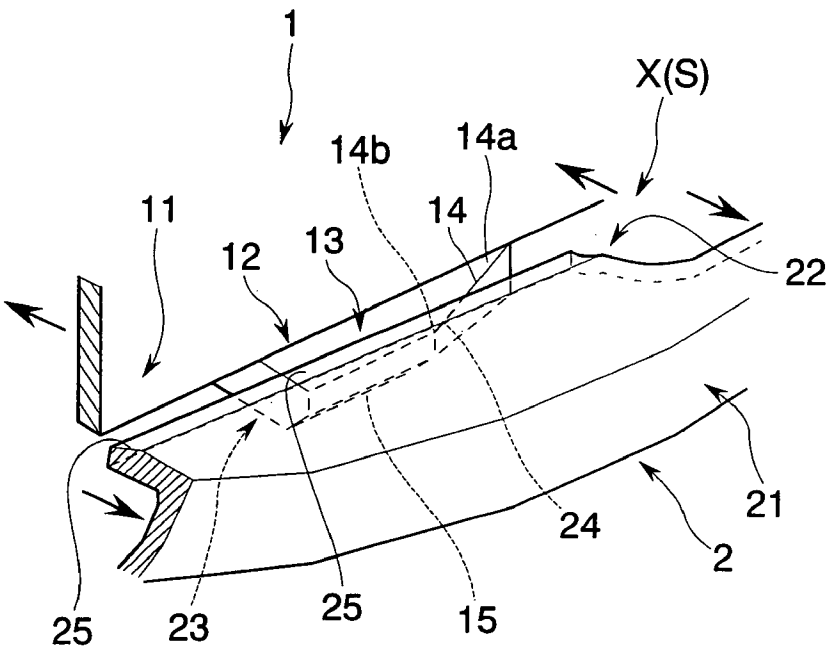
Figure 7:
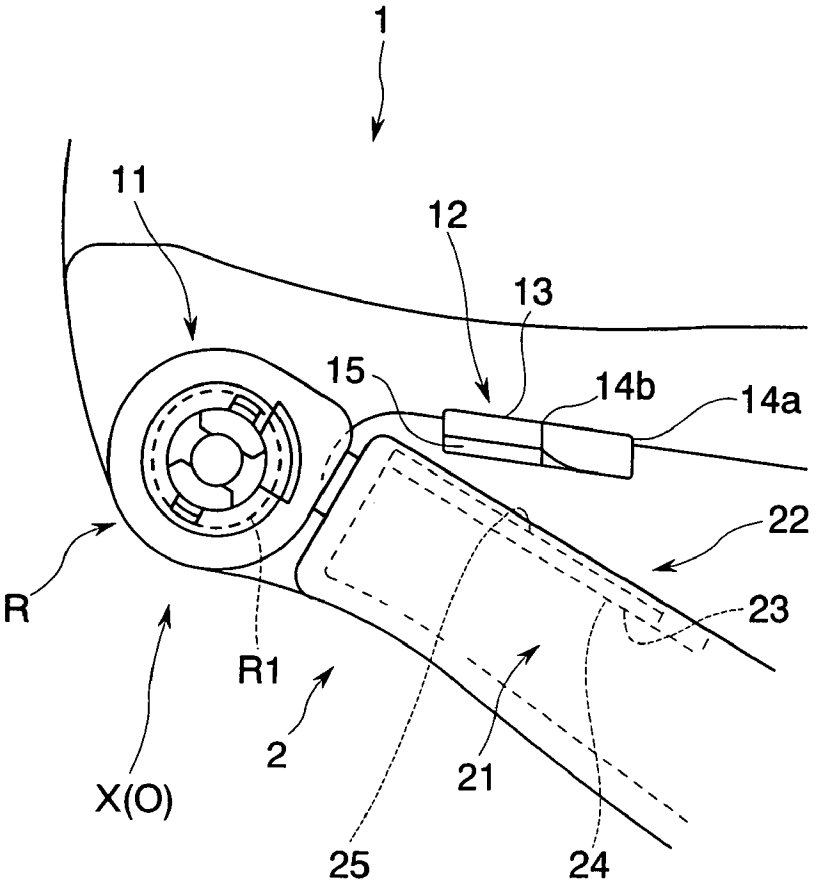
FIG. 7 is an illustration of a feature according to the same embodiment.
Figure 7:
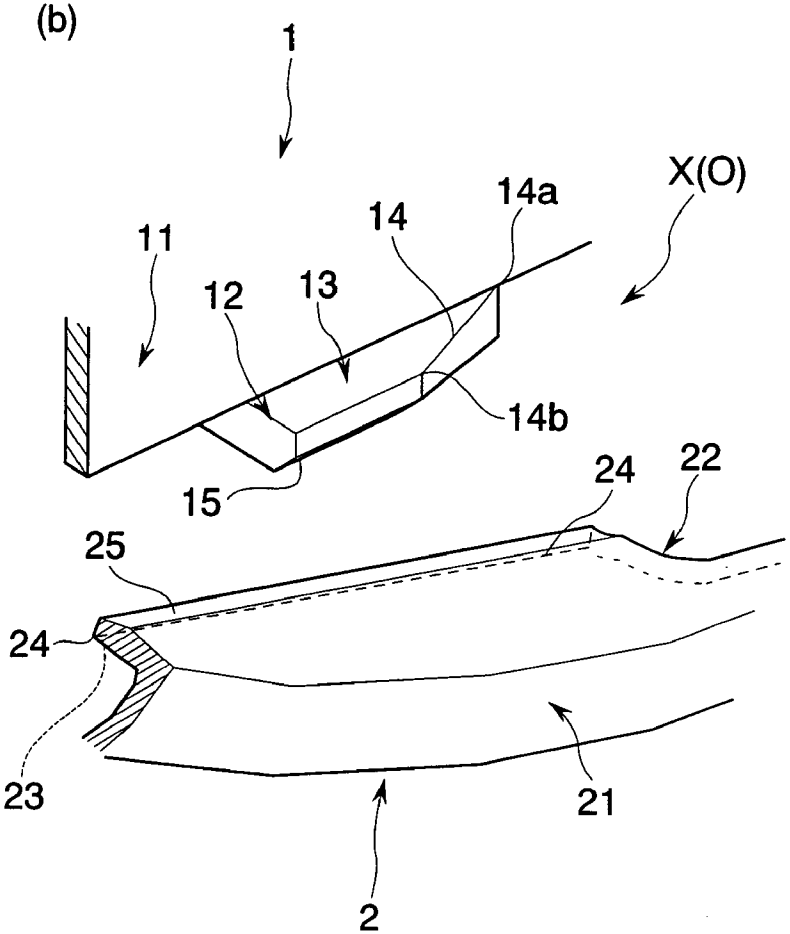

With reference to FIGS. 5 to 7, detailed description will be made of a series of operations of the engaging device X causing the transfer instrument A to take the open position O from the engaging position K through the relatively retracting action S.

FIG. 5 illustrates the engaging device X in the engaging position K. In the engaging position K, the ridge 22 of the arm 2 is positioned above the projection 12 of the dangling wall 11 and the two engaging surfaces 13 and 23 face each other as shown in FIG. 5(*a*). Strictly speaking, if an external force causes the arm 2 in the engaging position K to pivot toward the open position O even a little, the first end portion 14*a* of the guide edge 14 is pressed by the sliding contact edge 24 more strongly than the opposite second end portion 14*b* because the amount of move of the arm 2 on the distal pivoting end side is larger than that on the proximal pivoting end side. As a result, the two engaging surfaces 13 and 23 face each other in a slanted fashion with the first end portion 14*a* positioned closer to the sliding contact edge 24.

When an external force is exerted in the direction from the aforementioned engaging position K toward the open position O, the projection 12 and the ridge 22 perform the relatively retracting action S by which the projection 12 and the ridge 22 are retracted from each other temporarily. Specifically, as the sliding contact edge 24 presses against the guide edge 14 gradually from the first end portion 14*a* toward the opposite second end 14*b*, the position of the sliding contact edge 24 and that of the guide edge 14 become spaced apart from each other in the widthwise direction, i.e., the thicknesswise direction of the dangling wall 11. As described above, the pivoting mechanism R is configured to allow the transfer instrument body 1 and the arm 2 to move in the widthwise direction at that time. Further, the dangling wall 11 formed of synthetic resin becomes deflected in the thicknesswise direction to allow the projection 12 and the ridge 22 to perform the relatively retracting action S by which the projection 12 and the ridge 22 are moved away from each other in the widthwise direction.

As the arm 2 pivots further from the state shown in FIG. 6, the sliding contact edge 24 presses against the guide edge 14 until it reaches the opposite second end portion 14*b* and then the arm 2 takes the open position in which the ridge 22 of the arm 2 is positioned below the projection 12 as shown in FIG. 7.

On the other hand, when an external force causes the arm 2 to pivot toward the engaging position K from the open position O shown in FIG. 7, the retraction guide surfaces 15 and 25, which are formed on the projection 12 and the ridge 2, respectively, become abutted against each other to allow the projection 12 and the ridge 22 to perform the relatively retracting action S before they take the engaging position K shown in FIG. 5.

As described above, the transfer instrument A according to the present embodiment is capable of advantageous switchover from the state taking the engaging position k in which the transfer instrument body 1 and the arm 2 hold the piece of paper P as the transfer object therebetween to allow the transferee to be transferred to the piece of paper P to the state taking the open position O which is assumed by releasing the engaging position K and which allows the transferee to be suitably transferred to the transfer object placed on a desk for example like a conventional transfer instrument. Particularly, the provision of the engaging device X makes it possible to effectively reduce the load to be imposed on the projection 12 and ridge 22 serving as the first and second engaging components respectively provided on the transfer instrument body 1 and the arm 2, thereby to improve the transfer instrument A in its own durability effectively.

Since the engaging device X according to the present embodiment includes the guide edge 14 formed on the projection 12 serving as the first engaging component, the sliding contact edge 24 formed on the ridge 22 serving as the second engaging component, and the position control means serving as the pivoting mechanism R allowing the relatively retracting action S to be performed, the engaging device X is capable of gradually moving the second engaging surface 23 widthwise of the first engaging surface 13 to allow the relatively retracting action S to be performed to retract the two engaging components relative to each other by moving the dangling wall 11 corresponding to the first member provided on the transfer instrument body 1 and the sidewall 21 corresponding to the second member provided on the arm 2 relative to each other to press the sliding contact edge 24 against the guide edge 14 gradually from the first end portion 14*a* of the guide edge 14 toward the opposite second end portion 14*b* of the guide edge 14. Thus, such gradual switchover from the engaging position K to the open position O makes it possible to reduce the load to be imposed on the projection 12 and ridge 22 as well as to release the engagement between the projection 12 and the ridge 22 by a lessened working force. Further, in releasing the engagement the engaging device X can impart the user with a sense of being resisted for a certain period of time during which the sliding contact edge 24 is in sliding contact with the guide edge 14 and hence allows the user to notice the switchover from the engaging position K to the open position O clearly. Moreover, even though the engaging device X is capable of releasing the engagement by a lessened external force, the engagement cannot be released unless such an external force is exerted for a certain period of time. For this reason, it is not likely that the engagement is released accidentally.

The present embodiment is configured such that the two engaging surfaces 13 and 23 become slanted relative to each other in such a manner as to come closer to each other on the first end portion 14*a* side of the guide edge 14 at the time the arm 2 starts pivoting downwardly in the engaging position K. This configuration advantageously allows the sliding contact edge 24 to press against the guide edge 14 gradually from the first end portion 14*a* toward the opposite second end portion 14*b*.

Since the pivoting mechanism R connecting the transfer instrument body 1 and the arm 2 for pivotal movement is employed as the position control means, a simplified structure and a high operational precision are realized. Also, since the first end portion 14*a* of the guide edge 14 is positioned on the distal pivoting end side, a structure is realized which allows the sliding contact edge 24 to press against the guide edge 14 gradually from the distal pivoting end side on which the amount of move is relatively large. This structure makes it possible to allow the engaging device X to take the open position O with a reduced pivoting range and a lessened external force as well as to reduce the load to be imposed on the pivoting mechanism R by the relatively retracting action S. Even if the two engaging surfaces 13 and 23 are configured to contact each other intimately, the sliding contact edge 24 is allowed to press against the guide edge 14 gradually from the first end portion 14*a* toward the opposite second end portion 14*b* of the guide edge 14 when the arm 2 pivots even a little toward the open position O, whereby the relatively retracting action S can be performed advantageously. Further, since the pivoting mechanism R is configured to allow the transfer instrument body 1 and the arm 2 to move in the widthwise direction during the relatively retracting action S, the engaging device X effectively avoids being provided with an additional special structure for the projection 12 and the ridge 22 to perform the relatively retracting action S.

In addition, for the relatively retracting action S to be performed more smoothly, the dangling wall 11 is configured to become deflected in the widthwise direction for the relatively retracting action S. Specifically, the dangling wall 11 is formed of resin and thicknesswise elastic deformation of the dangling wall 11 is utilized to allow the relatively retracting action S to be performed. Thus, an advantageous structure is realized for causing the dangling wall 11 to become deflected by utilizing the properties of resin.

Further, since the projection 12 and the ridge 22 are formed with respective of the retraction guide surfaces 15 and 25 for allowing the relatively retracting action S to be performed when an external force is exerted to move the projection 12 and the ridge 22 from the open position O toward the engaging position K, the relatively retracting action S can be performed smoothly not only during switchover from the engaging position K to the open position O but also during switchover from the open position O to the engaging position K.

Moreover, the transfer instrument A is structured to cause the projection 12 and the ridge 22 to face each other at a location close to the proximal pivoting end of the pivoting mechanism R thereby enabling principal mechanical parts of the transfer instrument A including the transfer head H to be disposed on the distal pivoting end side advantageously.

Figure 8:
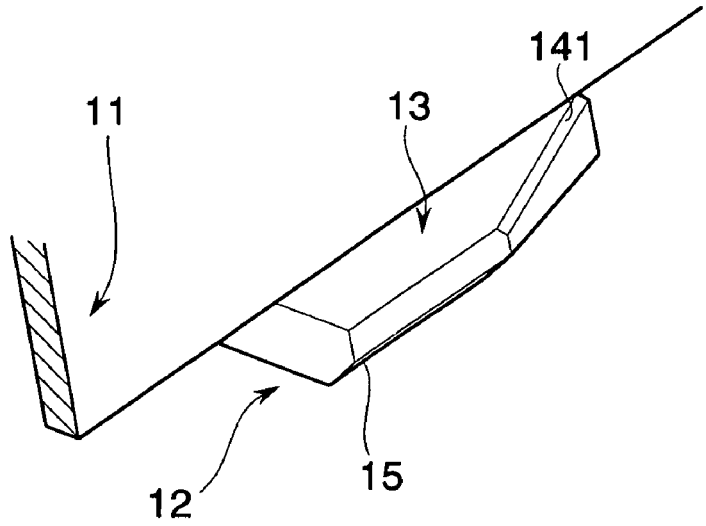
FIG. 8 is an enlarged view showing a portion of concern of an engaging device according to a variation of the same embodiment.
Figure 8:
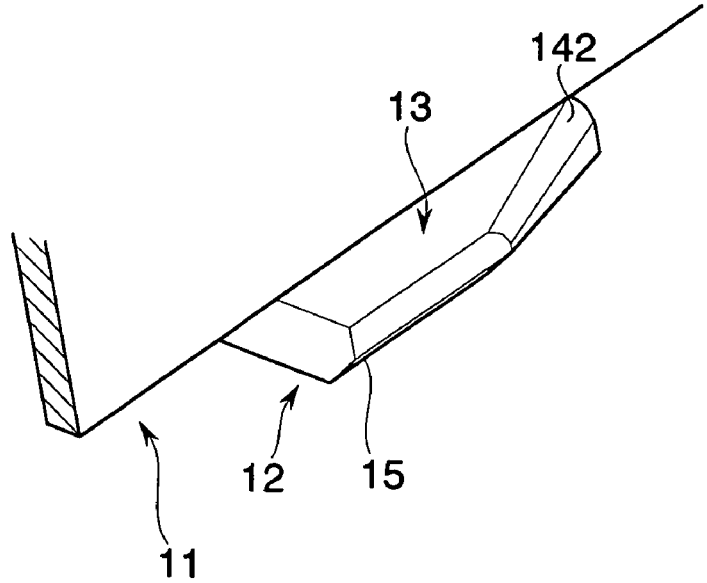

FIGS. 8(*a*) and 8(*b*) show guide edges 141 and 142, respectively, each of which is formed on the projection 12 of the dangling wall 11 according to a variation of the present embodiment. The guide edge 141 is formed by flat-chamfering the guide edge 14, while the guide edge 142 formed by round-chamfering the guide edge 14.

Each of the guide edges 141 and 142 can reduce the load to be imposed thereon and on the sliding contact edge 24 thereby allowing the engaging surface 23 to move in the widthwise direction more advantageously. Further, the guide edge 141 or 142 and the sliding contact edge 24 can effectively avoid being worn or damaged due to continuous use.

Figure 9:
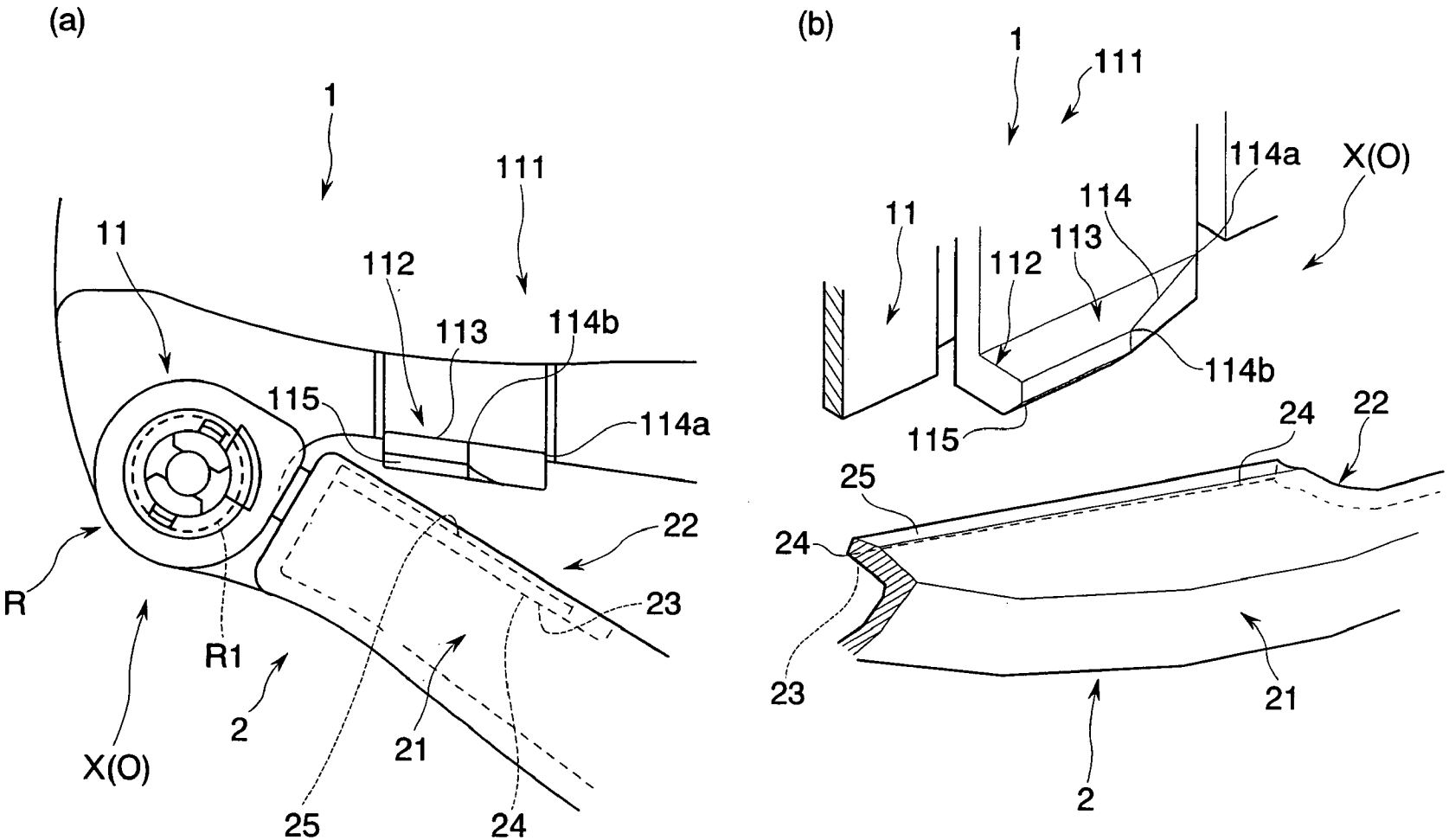
FIG. 9 is an illustration of a feature according to another variation of the same embodiment.

An engaging device X as shown in FIG. 9 is another variation of the present embodiment. This engaging device X has an elastic wall 111 downwardly protruding from the transfer instrument body 1, the elastic wall 111 being provided as the first member separately from the dangling wall 11. Specifically, the dangling wall 11 is partially recessed in the widthwise direction and the downwardly protruding elastic wall 111 which is separate from the dangling wall 11 is provided in the recessed portion. The elastic wall 111 has a protruding edge formed with projection 112 of substantially the same shape as in the aforementioned embodiment. Various examples of such a configuration having separate provision of the dangling wall 11 and the elastic wall 111 include: a configuration wherein the dangling wall 11 is formed integrally with frame 10 (not shown) and the elastic wall 111 is attached to the frame 10 separately from the dangling wall 11; a configuration wherein the elastic wall 111 is formed integrally with the frame 10 and the dangling wall 11 is separately provided; and a configuration wherein the dangling wall 11 is formed integrally with the frame 10 and separate case body C1 (not shown) is formed integrally with the elastic wall 111 dangling downwardly therefrom.

Such a configuration can provide for the engaging device X capable of advantageous switchover between the engaging position K and the open position O, wherein: the elastic wall 111, which serves as the first member of the present invention and is separate from the dangling wall 11, is formed to have appropriately adjusted thickness and width; the dangling wall 11 is imparted with appropriate rigidity and shape for suitably positioning the piece of paper P; and material, shape and the like are appropriately selected for the elastic wall 111 to allow the relatively retracting action S to be performed advantageously.

While only certain presently preferred embodiments of the present invention have been described in detail, as will be apparent for those skilled in the art, certain changes or modifications may be made in embodiment without departing from the scope of the present invention as defined by the following claims. For example, the position control means may be configured to move the first and second members toward and away from each other by an advance/retreat action or sliding action instead of employing the pivoting mechanism for allowing the first and second members to pivot as in the foregoing embodiment.

What is claimed is:

1. An engaging device comprising:

a first member having a first engaging component with a first engaging surface, and a second member having a second engaging component with a second engaging surface capable of facing the first engaging surface, the first and second engaging components being capable of taking an engaging position in which the first and second engaging surfaces face each other and an open position in which the first and second engaging surfaces are spaced apart from each other, switchably through a relatively retracting action to retract the first and second engaging components relative to each other temporarily;

a chamfered guide edge formed on the first engaging component in such a manner as to increase a width of the first engaging surface gradually as the guide edge extends from a first end side thereof to an opposite second end side thereof;

a sliding contact edge formed on the second engaging component to extend obliquely relative to the guide edge and capable of abutting against the guide edge; and position control means configured to press the sliding contact edge against the guide edge gradually from the first end side of the guide edge toward the opposite second end side of the guide edge when an external force is exerted to move the engaging components from the engaging position toward the open position;

wherein the first member is formed with a ridge serving as the first engaging component, the ridge having one surface serving as the first engaging surface and a protruding edge formed with the guide edge, wherein a first chamfered retraction guide surface is formed between the surface opposite the first engaging surface and the protruding edge;

the second member is formed with a ridge serving as the second engaging component, the ridge having one surface serving as the second engaging surface and a protruding edge formed with the sliding contact edge; wherein a second chamfered retraction guide surface is formed between the surface opposite the second engaging surface and the protruding edge, wherein the second retraction guide surface is capable of abutting against the first retraction guide surface; and when an external force is exerted to move the first and second engaging components from the engaging position toward the open position, the relatively retracting action is performed.

2. The engaging device according to claim 1, wherein the first and second engaging surfaces are slanted relative to each other to become close to each other on the first end side.

3. The engaging device according to claim 1, wherein the position control means comprises a pivoting mechanism connecting the first and second members for pivotal movement.

4. The engaging device according to claim 3, wherein the first end side of the guide edge is positioned on a distal pivoting end side.

5. The engaging device according to claim 4, wherein the pivoting mechanism has a pivoting shaft configured to move the first and second members widthwise of the first engaging surface to allow the relatively retracting action to be performed.

6. The engaging device according to claim 4, wherein at least one of the first and second members is capable of becoming deflected widthwise of the first engaging surface to allow the relatively retracting action to be performed.

7. A transfer instrument comprising: a transfer instrument body having a transfer head capable of transferring a transferee to such a transfer object as paper; an arm accompanying the transfer instrument body for backing up the transfer object; and an engaging device capable of engaging the transfer instrument body with the arm, the engaging device including:

first and second members each provided on a respective one of the transfer instrument body and the arm, the first member having a first engaging component with a first engaging surface, the second member having a second engaging component with a second engaging surface capable of facing the first engaging surface, the first and second engaging components being capable of taking an engaging position in which the first and second engaging surfaces face each other while the arm and a tip portion of the transfer head are positioned to be capable of holding the transfer object therebetween and an open position in which the first and second engaging surfaces are spaced apart from each other while the tip portion of the transfer head exposed, switchably through a relatively retracting action to retract the first and second engaging components relative to each other temporarily;

a chamfered guide edge formed on the first engaging component in such a manner as to increase a width of the first engaging surface gradually as the guide edge extends from a first end side thereof to an opposite second end side thereof;

a sliding contact edge formed on the second engaging component to extend obliquely relative to the guide edge and capable of abutting against the guide edge; and position control means configured to press the sliding contact edge against the guide edge gradually from the first end side of the guide edge toward the opposite second end side of the guide edge when an external force is exerted to move the engaging components from the engaging position toward the open position;

wherein the first member forms a sidewall provided on the transfer instrument body and the sidewall is formed with a ridge serving as the first engaging component, the ridge having one surface serving as the first engaging surface and a protruding edge formed with the guide edge, wherein a first chamfered retraction guide surface is formed between the surface opposite the first engaging surface and the protruding edge;

the second member forms a sidewall provided on the transfer instrument body and the sidewall is formed with a ridge serving as the second engaging component, the ridge having one surface serving as the second engaging surface and a protruding edge formed with the sliding contact edge; wherein a second chamfered retraction guide surface is formed between the surface opposite the second engaging surface and the protruding edge, wherein the second retraction guide surface is capable of abutting against the first retraction guide surface; and when an external force is exerted to move the first and second engaging components from the engaging position toward the open position, the relatively retracting action is performed.

8. The transfer instrument according to claim 7, wherein the first and second engaging surfaces are slanted relative to each other to become close to each other on the first end side.

9. The transfer instrument according to claim 7, wherein the position control means comprises a pivoting mechanism connecting the transfer instrument body and the arm for pivotal movement.

10. The transfer instrument according to claim 9, wherein the first end side of the guide edge is positioned on a distal pivoting end side.

11. The transfer instrument according to claim 10, wherein:

the two ridges are positioned to face each other at a location adjacent proximal pivoting ends of the sidewalls.

12. The transfer instrument according to claim 9, wherein the pivoting mechanism has a pivoting shaft configured to move the first and second members widthwise of the first engaging surface to allow the relatively retracting action to be performed.

13. The transfer instrument according to claim 9, wherein at least one of the first and second members is capable of becoming deflected widthwise of the first engaging surface to allow the relatively retracting action to be performed.

14. The transfer instrument according to claim 13, wherein:

at least one of the sidewalls is formed of resin and thicknesswise elastic deformation of the sidewall is utilized to allow the relatively retracting action to be performed.

* * * * *